US012343593B2

(12) United States Patent
An

(10) Patent No.: US 12,343,593 B2
(45) Date of Patent: Jul. 1, 2025

(54) CHEST EXPANDER

(71) Applicant: GD IND Corp., Incheon (KR)

(72) Inventor: Tae Jin An, Incheon (KR)

(73) Assignee: GD IND Corp., Incheon (KR)

( * ) Notice: Subject to any disclaimer, the term of this patent is extended or adjusted under 35 U.S.C. 154(b) by 109 days.

(21) Appl. No.: 18/303,798

(22) Filed: Apr. 20, 2023

(65) Prior Publication Data

US 2023/0364464 A1 Nov. 16, 2023

(30) Foreign Application Priority Data

May 16, 2022 (KR) ..... 10-2022-0059352

(51) Int. Cl.

| | |
|---|---|
| ***A63B 23/02*** | (2006.01) |
| ***A63B 21/00*** | (2006.01) |
| ***A63B 21/008*** | (2006.01) |
| ***A63B 23/12*** | (2006.01) |

(52) U.S. Cl.

CPC ..... *A63B 23/12* (2013.01); *A63B 21/0085* (2013.01); *A63B 21/0087* (2013.01); *A63B 21/4035* (2015.10); *A63B 23/02* (2013.01); *A63B 23/0205* (2013.01); *A63B 2225/09* (2013.01)

(58) Field of Classification Search

None

See application file for complete search history.

(56) References Cited

U.S. PATENT DOCUMENTS 4,429,871 A * 2/1984 Flechner ..... A63B 23/0355 482/138
5,634,874 A * 6/1997 Kest ..... A63B 21/157 482/44

(Continued)

FOREIGN PATENT DOCUMENTS

CN 109621320 A * 4/2019 ..... A63B 21/055
CN 109078303 B * 6/2020 ..... A63B 23/1209

(Continued)

OTHER PUBLICATIONS

Office Action issued in Japanese Patent Application No. 2023-076989, with a partial English translation, dated Nov. 28, 2023 (4 pages).

(Continued)

*Primary Examiner* — Shila Jalalzadeh Abyaneh

(74) *Attorney, Agent, or Firm* — Osha Bergman Watanabe & Burton LLP

(57) ABSTRACT

The present invention relates to a chest expander including a head, two operating arms of which upper end portions are coupled to the head using rotating shafts, and at least one gas spring disposed between and coupled to the two operating arms by a lower end of the gas spring being rotatably coupled to one operating arm and an upper end of the gas spring being coupled to an upper portion of the other operating arm, wherein a moving hole extending in an arc shape about the lower end of the gas spring is formed in the upper portion of the operating arm, a slider is provided to movably support the upper end of the gas spring along the moving hole, and the slider includes a stopper which fixes the slider.

7 Claims, 6 Drawing Sheets

(56) References Cited

U.S. PATENT DOCUMENTS

| | | | | |
|---|---|---|---|---|
| 9,028,378 | B2 * | 5/2015 | Shah | G05G 1/10 482/109 |
| 2015/0290491 | A1 * | 10/2015 | An | A63B 21/00069 482/49 |
| 2016/0354628 | A1 * | 12/2016 | Hao | A63B 21/023 |
| 2019/0366145 | A1 * | 12/2019 | Reda | A63B 1/00 |
| 2020/0376333 | A1 * | 12/2020 | An | A63B 23/1209 |
| 2022/0126166 | A1 * | 4/2022 | An | A63B 21/0083 |

FOREIGN PATENT DOCUMENTS

| | | | |
|---|---|---|---|
| JP | 3000735 | B2 | 1/2000 |
| JP | 3189179 | B2 | 7/2001 |
| JP | 2007-259433 | A | 10/2007 |
| JP | 2015-147542 | A | 8/2015 |
| JP | 2019-167693 | A | 10/2019 |
| JP | 2020-199872 | A | 12/2020 |
| JP | 2022-70826 | A | 5/2022 |
| KR | 10-2006-0012083 | A | 2/2006 |
| KR | 10-2022-0055961 | A | 5/2022 |

OTHER PUBLICATIONS

Office Action issued in Korean Patent Application No. 10-2022-0059352, with a partial English translation, dated Mar. 11, 2024 (6 pages).

* cited by examiner

[FIG 1]
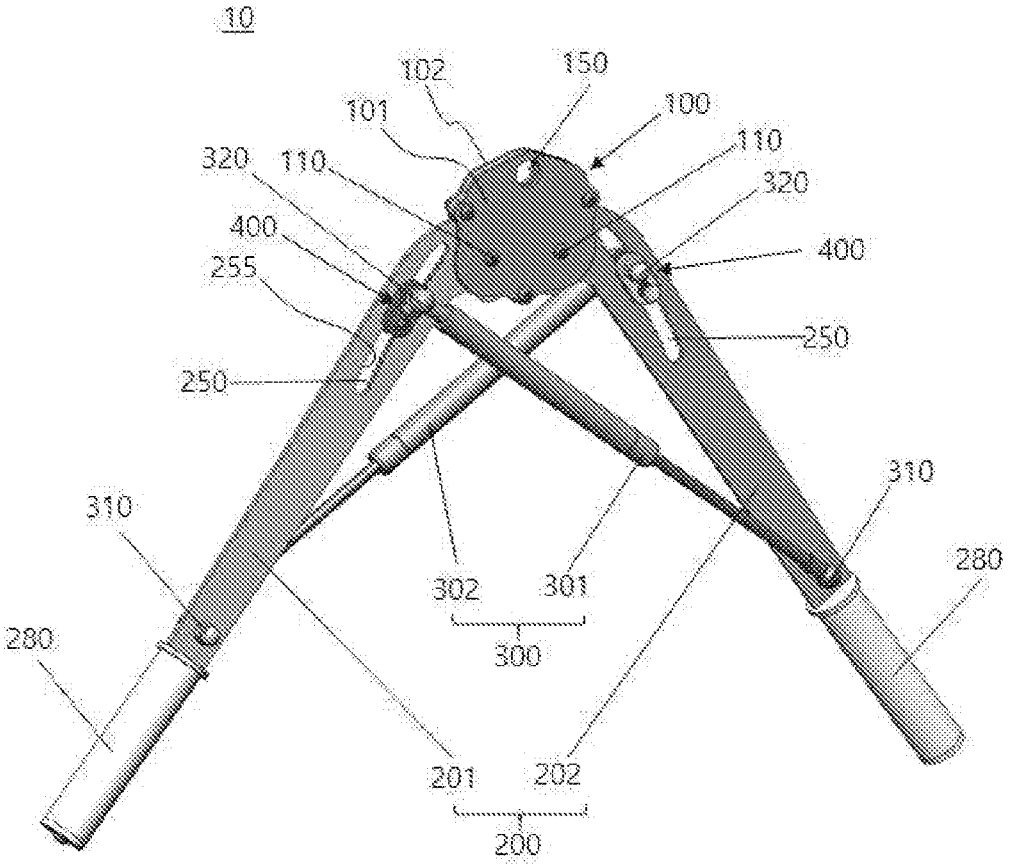

[FIG 2]
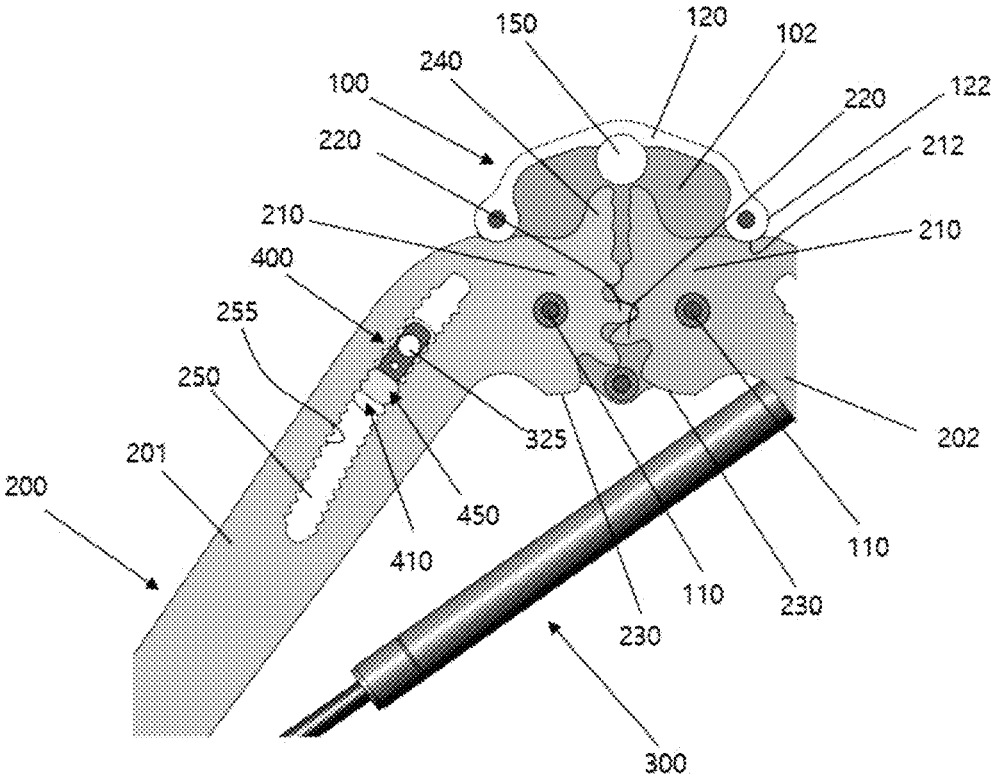

[FIG 3]
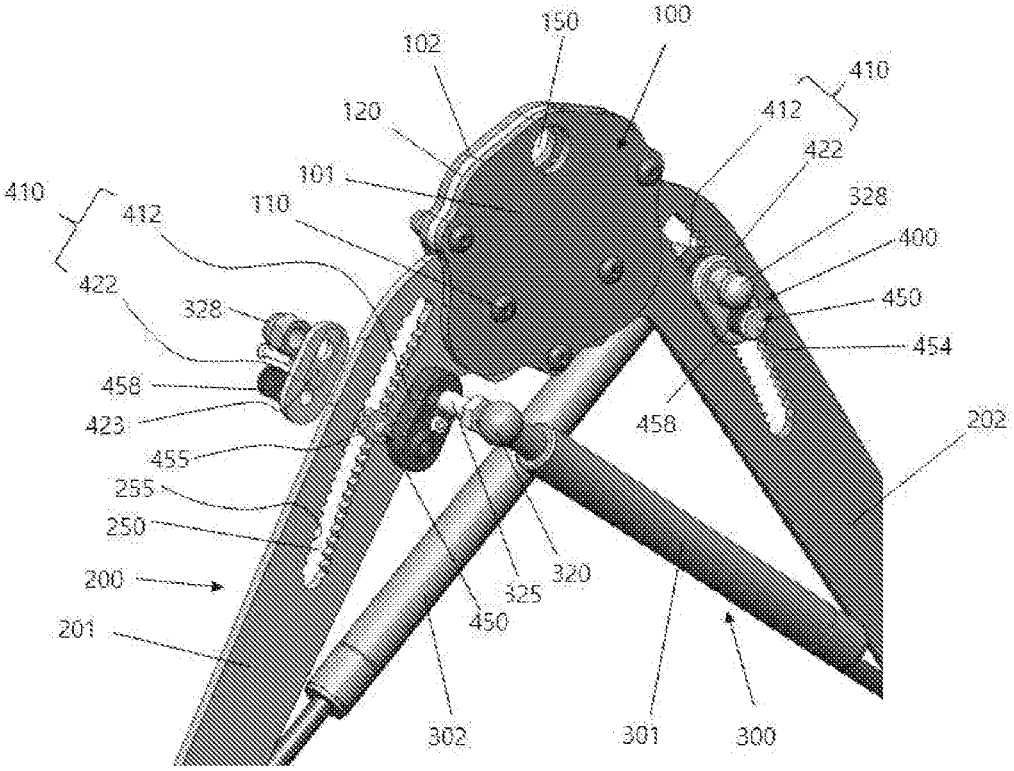

[FIG 4]
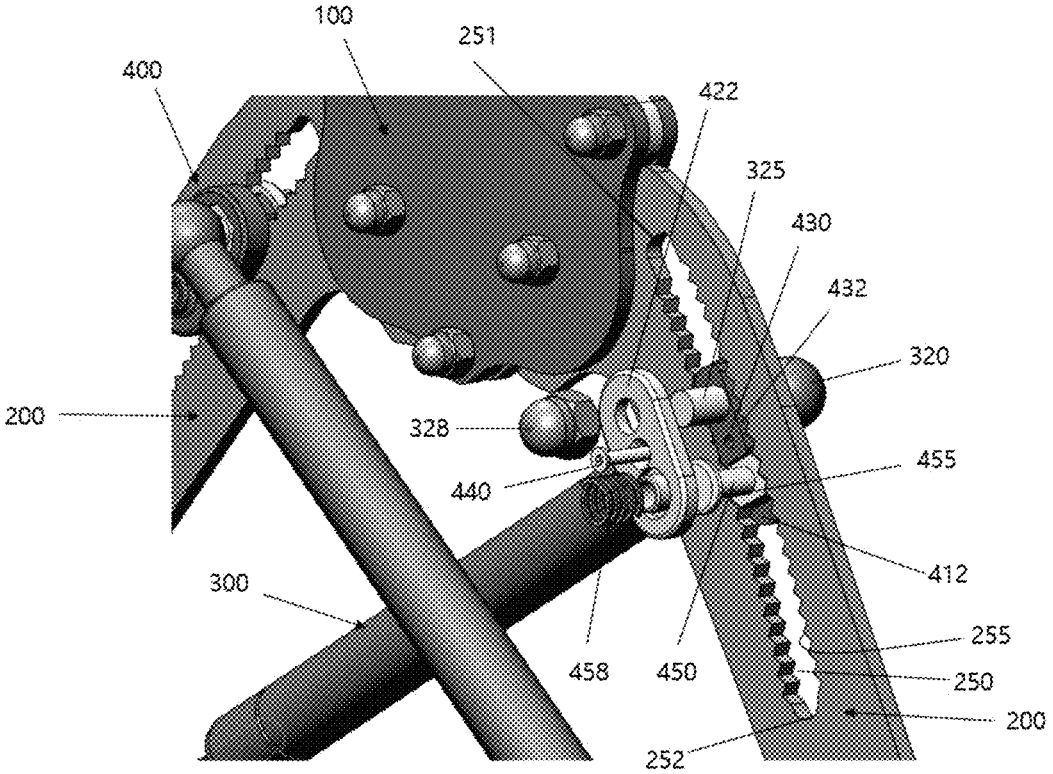

[FIG 5]
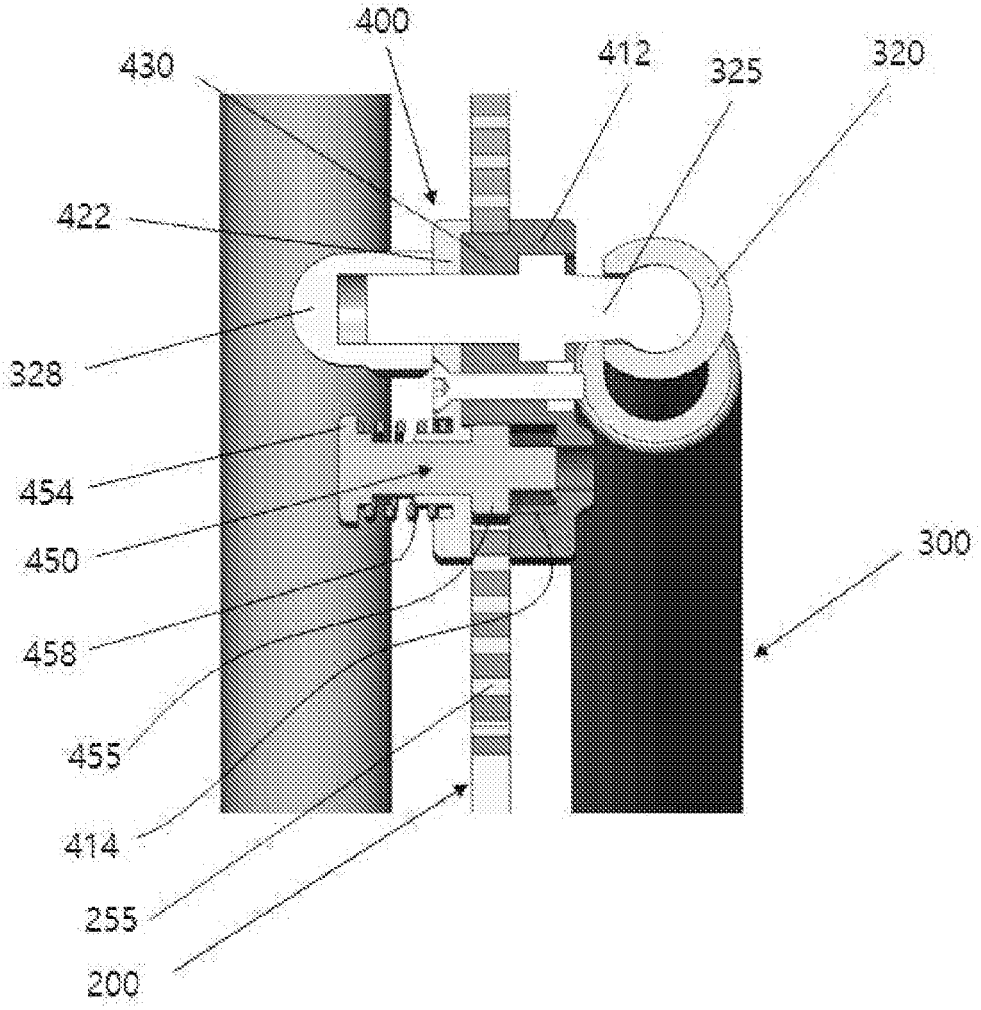

[FIG 6]
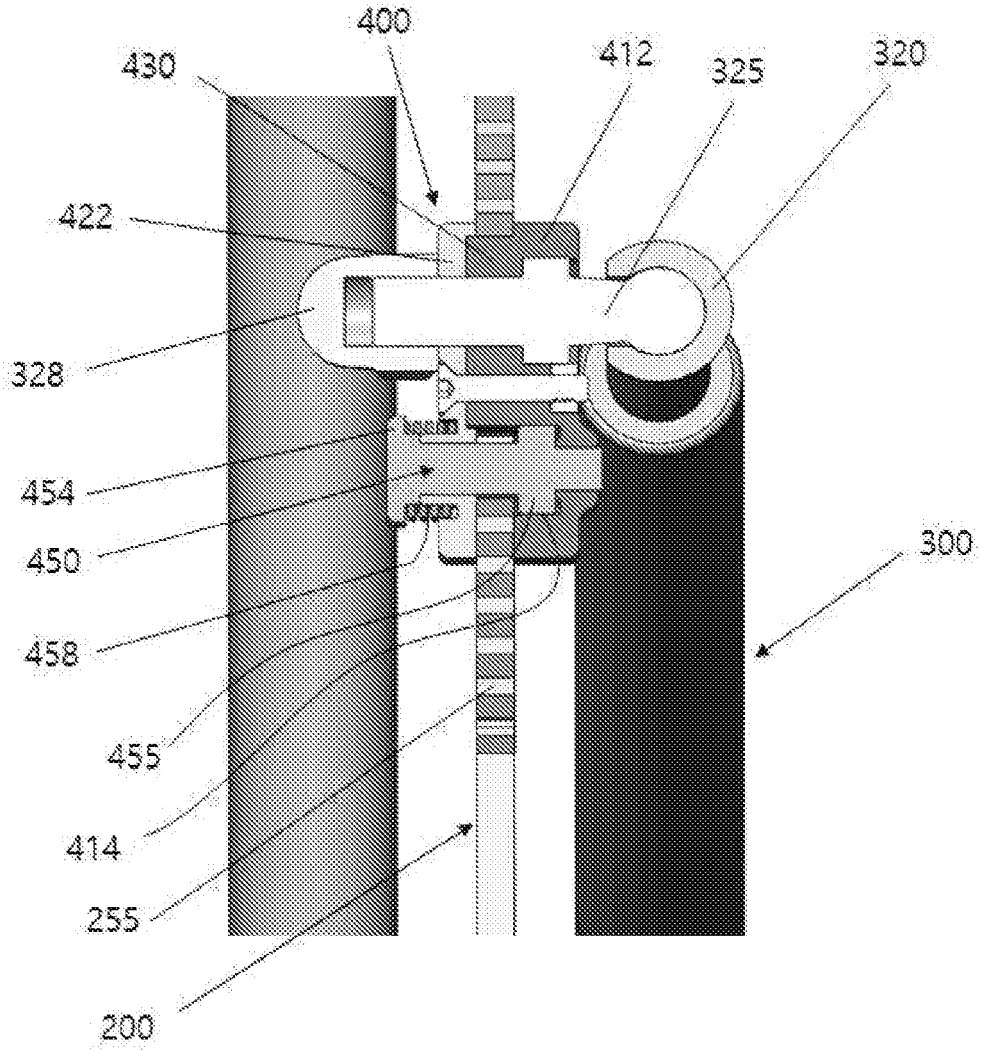

CHEST EXPANDER

This application claims priority to and the benefit of Korean Patent Application No. 2022-0059352, filed on May 16, 2022, the disclosure of which is incorporated herein by reference in its entirety.

BACKGROUND

1. Field of the Invention

The present invention relates to a chest expander, and more specifically, to a chest expander which includes a pair of operating arms and a pair of gas springs and in which a magnitude of an elastic force provided by the gas springs is adjusted

2. Discussion of Related Art

Generally, a chest expander is exercise equipment used to train muscular strength of arms, shoulders, and the like, and includes a head on which a spring is installed and a pair of operating arms operably connected to springs.

With a chest expander, a user exercises by repeatedly performing motions of holding the left and right operating arms with both hands, pushing the two operating arms together so that muscle strength is applied to his or her arms, shoulders, and the like, and releasing the force so that the operating arms are separated from each other and return to their original positions to relax the muscle strength of the arms, shoulders, and the like.

However, the conventional chest expanders had a disadvantage that a user cannot easily adjust a magnitude of an elastic force to match his or her own muscle strength.

SUMMARY OF THE INVENTION

The present invention is directed to providing a chest expander in which the magnitude of an elastic force provided by a gas spring is adjustable, allowing the user to adjust the magnitude to match the user's muscle strength for training the muscle strength.

According to an aspect of the present invention, there is provided a chest expander including a head, two operating arms of which upper end portions are coupled to the head using rotating shafts and which operate to move toward or away from each other, and at least one gas spring disposed between and coupled to the two operating arms, with a lower end of the gas spring being rotatably coupled to one operating arm and an upper end of the gas spring being coupled to an upper portion of the other operating arm, wherein a moving hole extending in an arc shape about the lower end of the gas spring is formed in the upper portion of the operating arm to which the upper end of the gas spring is coupled, a slider is provided to movably support the upper end of the gas spring along the moving hole, and the slider includes a stopper engaged in the moving hole to fix the upper end of the gas spring at an adjusted position.

Coupling teeth may be formed along a longitudinal inner surface of the moving hole, the stopper of the slider may include engaging teeth engaged with the coupling teeth, and the stopper may be formed to move between an engaging position at which the engaging teeth are coupled to the coupling teeth to fix the slider at the adjusted position and a release position at which the engaging teeth escape from the coupling teeth to allow the slider to move.

Tooth parts may be formed on outer circumferential surfaces of upper end portions of the two operating arms, and the two operating arms may be coupled to the head so that the tooth parts are rotatably engaged with each other.

The gas spring may include two gas springs, and the two gas springs may be alternately disposed on a front surface and a rear surface of the two operating arms.

The slider may include a slide body that comprises a first body and a second body which are disposed on opposite side surfaces of each of the operating arms and coupled to each other with the moving hole interposed between them. The slider body is coupled to a coupling shaft of the upper end of the gas spring. Wherein, the stopper may be movably disposed between and supported by the first body and the second body and have a shaft shape, the engaging teeth may be formed to protrude from an axial central portion of the stopper, and the stopper may move in an axial direction intersecting the moving hole so that the engaging teeth are disposed in the moving hole at the engaging position or escape outward from the moving hole to be disposed at the release position.

The chest expander may include a support spring which presses the stopper toward the engaging position so that the engaging teeth of the stopper remain at the engaging position at which the engaging teeth are engaged with the coupling teeth in the moving hole.

An accommodation groove which accommodates the engaging teeth of the stopper and at which the release position is formed may be formed in an inner surface of the first body, and when the stopper is pressed, the stopper may move in the axial direction while pressing the support spring so that the engaging teeth are accommodated in the accommodation groove.

The stopper may extend outward from the second body, a flange may be formed at an upper end of the stopper, and the support spring may be interposed between the flange and the second body.

The slider body may include a moving guide disposed in the moving hole and having a smooth surface on a side surface facing the coupling teeth of the moving hole.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIG. 1 is a view illustrating an overall shape of a chest expander according to the present invention;

FIG. 2 is a partial cross-sectional view illustrating the chest expander and shows coupling relationships between a head and operating arms according to the present invention;

FIGS. 3 and 4 are views illustrating components of sliders and coupling states of the components in the chest expander according to the present invention;

FIG. 5 is a partial cross-sectional view for describing a state in which a stopper is at an engaging position in a slider; and FIG. 6 is a partial cross-sectional view for describing a state in which the stopper moves to a release position in the slider.

DETAILED DESCRIPTION OF EXEMPLARY EMBODIMENTS

While the present invention may be modified in various ways and have various alternative forms, specific embodiments thereof will be described in detail below. However, there is no intent to limit the present invention to disclosed specific forms, and it should be understood that the present invention covers all modifications, equivalents, and alternatives falling within the range of the spirit and scope of the present invention. When the present invention is described with reference to the accompanying drawings, like numbers refer to like elements.

Terms used herein are only for distinguishing one element from other elements. The terms used in the present disclosure are for the purpose of describing particular embodiments only and are not intended to limit the present invention. The singular forms include the plural forms, unless the context clearly indicates otherwise.

FIG. 1 is a view illustrating an overall shape of a chest expander according to the present invention. FIG. 2 is a partial cross-sectional view illustrating the chest expander and shows coupling relationships between a head and operating arms according to the present invention.

Referring to FIGS. 1 and 2, a chest expander 10 according to the present invention includes a head 100, two operating arms 200, gas springs 300 disposed to intersect each other between the two operating arms 200, and sliders 400 which allow coupling positions to be adjusted between the operating arms 200 and upper ends 320 of the gas springs 300.

The head 100 is positioned in the middle of an upper portion of the chest expander, and the two operating arms 200 are rotatably coupled to the head 100 using rotating shafts 110. The head 100 includes a front plate 101 and a rear plate 102, and upper end portions of the operating arms 200 are coupled in an installation space between the front plate 101 and the rear plate 102.

The two operating arms 200 include one side operating arm 201 and the other side operating arm 202 which are symmetrically disposed with respect to a center line of the head 100 and move toward and away from each other. In this specification, the reference numeral 200 is representatively assigned to each of the operating arms, and the reference numerals 201 and 202 are used when the two operating arms need to be distinguished from each other.

The gas springs 300 are disposed to intersect each other between the two operating arms 200. Each of lower ends 310 of the gas springs 300 is coupled to the one side operating arm 201 or 202, and each of the upper ends 320 is coupled to the other side operating arm 202 or 201. When the two operating arms 200 move toward each other, the gas springs 300 provide a force in directions which interfere with the movement of the two operating arms 200.

The upper ends 320 of the gas springs 300 and the operating arms 200 are coupled so that coupling positions are adjustable.

Moving holes 250 to which the upper ends 320 of the gas springs 300 are movably coupled are formed in upper portions of the operating arms 200. The moving holes 250 extend along arcs about the lower ends 310 of the gas springs rotatably coupled to the operating arms 200.

The sliders 400 are coupled to the upper ends 320 of the gas springs 300, and the coupling positions of the upper ends 320 of the gas springs 300 are adjusted by the sliders 400 moving along the moving holes 250 or being fixed to adjusted positions.

According to an embodiment of the present invention, two gas springs 300 may be disposed to intersect each other between the two operating arms 200. In this specification, the reference numeral 300 is representatively assigned to each of the gas springs, and the terms "one side gas spring" and "the other side gas spring" are used when the plurality of gas springs need to be distinguished from each other, and the reference numerals 301 and 302 may be assigned thereto.

As shown in FIG. 2, upper end portions 210 of the operating arms 200 are disposed in the installation space between the front plate 101 and the rear plate 102. The upper end portions 210 of the operating arms 200 are rotatably supported by the rotating shafts 110 fixedly passing through the front plate 101 and the rear plate 102.

A shoulder arm 120 is disposed between the front plate 101 and the rear plate 102 along an upper edge of the head 100. The shoulder arm 120 supports the installation space defined between the front plate 101 and the rear plate 102. In addition, contact portions 122 which are in contact with upper surfaces 212 of the upper end portions 210 of the operating arms 200 to support the operating arms 200 are formed at end portions of both sides of the shoulder arm 120. The contact portions 122 are in contact with the upper surfaces 212 of the upper end portions to maintain the operating arms 200 at starting positions. The upper surfaces 212 of the upper end portions 210 of the operating arms 200 have outlines capable of coming into contact with the contact portion 122 to restrict the operating arms 200 from rotating beyond the starting positions. Grooves corresponding to the contact portions 122 may be formed in the upper surfaces 212. The shoulder arms 120 are fixed using fixing bolts fastened through the front plate 101, the contact portions 122, and the rear plate 102.

A hanging portion 150 may be formed in the head 100. The hanging portion 150 may be formed in a hole shape passing through the head 100, and the chest expander can be hung and stored on a ring attached to a wall.

Referring to FIGS. 1 and 2, the operating arms 200 are formed as plate-shaped arms of which the upper end portions 210 are coupled to the head 100 using the rotating shafts 110 and which extend downward. Handles 280 which may be gripped by a user are provided on lower portions of the operating arms 200. When the user grips the handles 280 and applies a force to the operating arms 200, the operating arms 200 rotate about the rotating shafts 110 in directions in which lower end portions approach each other, and when the force is removed, the operating arms 200 return to the starting positions by an elastic force of the gas springs 300. In the present specification, positions at which a force is applied to the two operating arms 200 and the two operating arms 200 maximally approach each other are referred to as approach positions, and positions at which the force is removed and the two operating arms 200 are returned by an elastic force are referred to as the starting positions.

Tooth parts 220, which are engaged with each other, are formed in outer circumferential surfaces of the upper end portions 210 of the operating arms 200 which face each other and are coupled to the head 100 using the rotating shafts 110. The operating arms 200 operate in a state in which the tooth part 220 of the upper end portion 210 of the one side operating arm 201 and the tooth part 220 of the upper end portion 210 of the other side operating arm 202 are engaged with each other. Accordingly, movement of the one side operating arm 201 is linked with movement of the other side operating arm 202. Accordingly, the one side operating arm 201 and the other side operating arm 202 move symmetrically based on a central axis. Accordingly, the one side operating arm 201 and the other side operating arm 202 operate symmetrically even when different elastic forces are applied thereto.

Contact surfaces 230 which come into contact with each other when the operating arms 200 move to the approach positions may be formed under the tooth parts 220. When the one side operating arm 201 and the other side operating arm 202 rotate about the rotating shafts 110 to approach each other, the contact surfaces 230 may come into direct contact with each other or come into contact with each other with fixing bolts or the like interposed therebetween to define the approach positions.

Protrusions 240 extending upward may be formed on the tooth parts 220. The starting positions of the operating arms 200 may be set when the protrusions 240 come into contact with each other, and the approach positions may be set when the protrusions 240 come into contact with the contact portions 122 of the shoulder arm 120.

The above-described support part capable of supporting the operating arms 200 at the starting positions and the approach positions may be used together or used selectively, and such support part allows the operating arms 200 to operate between the set starting positions and the set approach positions while preventing separation of the operating arms 200.

The moving holes 250 to which the upper ends 320 of the gas springs 300 are movably coupled are formed in the upper portions of the operating arms 200, The moving holes 250 pass through surfaces of the upper portions of the operating arms 200 and are formed to extend in longitudinal directions of the operating arms 200. The moving holes 250 are formed in an arc shape along rotation paths of the upper ends 320 of the gas springs 300 about the lower ends 310 of the gas springs 300. The number of coupling teeth 255 in which each of the moving holes 250 is formed may determine an adjustment level of an elastic force.

The coupling teeth 255 are formed on longitudinal inner surfaces of the moving holes 250. The coupling teeth 255 are engaged with stoppers 450 in the moving hole 250 by engaging teeth 455 of the stoppers 450 of the sliders 400 being engaged with the coupling teeth 255. Accordingly, the sliders 400 may be fixed in the moving holes 250, and positions of the upper ends 320 of the gas springs 300 coupled to the sliders 400 can be fixed. When the engagement between the coupling teeth 255 and the stoppers 450 is released, with the sliders 400, the upper ends 320 of the gas springs 300 may be guided and moved along the moving holes 250.

The lower end 310 of the gas spring 300 is coupled to the one side operating arm 200, and the upper end 320 of the gas spring 300 is coupled to the moving hole 250 of the other side operating arm 200 using one slider 400. The lower ends 310 of the gas springs 300 include coupling end portions which extend in directions intersecting extension directions of the gas springs 300 and extend through surfaces of the operating arms 200 and fixing nuts which are fastened to the coupling end portions to fix the coupling end portions.

In one embodiment of the present invention, the two gas springs 300 may be included in the chest expander 10, and the two gas springs 300 may be alternately disposed on front and rear surfaces of the chest expander 10. For example, the upper end 320 of the one side gas spring 301 is coupled to the moving hole 250 of the one side operating arm 201 at the front surface of the chest expander, and the lower end 310 of the one side gas spring 301 is rotatably coupled to a lower portion of the other side operating arm 202. The upper end 320 of the other side gas spring 302 is coupled to the moving hole 250 of the other side operating arm 202 at the rear surface of the chest expander 10, and the lower end 310 of the other side gas spring 302 is rotatably coupled to a lower portion of the one side operating arm 201.

Since the upper ends 320 of the alternately disposed two gas springs 300 are individually coupled to the moving holes 250 using the sliders 400, positions of the upper ends 320 of the gas springs 300 are individually adjusted. Magnitudes of elastic forces provided by the two gas springs 300 may be adjusted differently.

In the chest expander 10 according to the present invention, since the upper end portions 210 of the operating arms 200 rotate while engaged with each other through the tooth parts 220, an elastic force applied to the operating arms 200 is distributed and applied to the operating arms 200. Accordingly, a magnitude of an applied elastic force when the operating arms 200 move can be adjusted in various levels by combining elastic force adjustment levels of the two gas springs 300.

FIGS. 3 and 4 are views illustrating components of sliders and coupling states of the components in the chest expander according to the present invention, FIG. 5 is a partial cross-sectional view for describing a state in which the stopper is at an engaging position in the slider, and FIG. 6 is a partial cross-sectional view for describing a state in which the stopper moves to a release position in the slider.

Referring to the drawings, the slider 400 includes a slider body 410 to which the upper end of the gas spring 300 is coupled and which is movably fixed along the moving hole 250 and one stopper 450 which is coupled to the slider body 410 and moves between the engaging position and the release position.

The slider body 410 includes a first body 412 disposed on one surface of the operating arm 200 and a second body 422 disposed on the other surface of the operating arm 200 with the moving hole 250 interposed therebetween. The first body 412 and the second body 422 are coupled to each other with the moving hole 250 interposed therebetween and guided by and moved along the moving hole 250.

A coupling shaft 325 is formed on the upper end 320 of the gas spring 300 in the direction intersecting the extension direction of the gas spring 300, and the coupling shaft 325 is coupled to the slider body 410. The coupling shaft 325 extends through the first body 412, a moving guide 430, and the second body 422, and a fixing nut 328 is fastened to an end portion of the coupling shaft 325. An increased diameter portion is provided at a portion of the coupling shaft 325 coupled to the first body 412, and thus the coupling shaft 325 may be coupled to the first body 412 at a predetermined position.

According to the embodiment of the present invention, the slider body 410 may include the moving guide 430 disposed in the moving hole 250 to guide the slider body 410 to move along the moving hole 250. A side surface 432 of the moving guide 430 facing the coupling teeth 255 is formed as a smooth flat surface. Accordingly, when the stopper 450 moves to the release position and the slider 400 fixed by the stopper 450 is unfixed, a smooth movement of the slider 400 may be guided along the moving hole 250.

Since the moving guide 430 extends from the first body 412 into the moving hole 250, and a seating groove 423 on which an end portion of the moving guide 430 is seated is formed in the second body 422, assembly of the first body 412 and the second body 422 is guided. A fixing member 440 may pass through the moving guide 430 to be used to fix the first body 412 and the second body 422 to each other.

The stopper 450 has a shaft shape and is movably disposed between and supported by the first body 412 and the second body 422. The engaging teeth 455 engaged with the coupling teeth 255 of the moving hole 250 are formed on an outer circumferential surface of a middle portion of a shaft-shaped portion of the stopper 450 to protrude outward. The stopper 450 is movably disposed between and supported by the first body 412 and the second body 422 in a direction intersecting the moving hole 250 in an axial direction of the stopper. Accordingly, by a movement of the stopper 450 in the axial direction intersecting the moving hole 250, the engaging teeth 455 may be disposed in the moving hole while engaging with the coupling teeth 255 at the engaging position, or may escape outward from the moving hole 250 and may be disposed at the release position while engagement with the coupling teeth 255 is released.

An accommodation groove 414 which allows the engaging teeth 455 to escape from the moving hole 250 when the stopper 450 moves to the release position is formed in the slider body 410. The accommodation groove 414 is formed in an inner surface of the first body 412 to accommodate the engaging teeth 455 when the stopper 450 escapes from the moving hole 250 and moves to the release position. FIG. 6 shows a state in which the stopper 450 has escaped from the moving hole 250 and moved to the release position, and in this case, the engaging teeth 455 are positioned in the accommodation groove 414.

The stopper 450 is elastically supported to maintain the engaging position. The stopper 450 extends outward from the second body 422, and a flange 454 is formed on an upper end portion of the stopper 450. A support spring 458 which presses the stopper 450 in a direction in which the flange 454 protrudes, that is, toward the engaging position, is provided between the flange 454 and the second body 422. The support spring 458 may be formed in the form of a coil spring, and a spring groove into which one end of the support spring 458 is inserted may be formed in a surface of the second body 422.

Referring to FIG. 5, the stopper 450 is elastically supported by the support spring 458 so that the engaging teeth 455 are maintained at the engaging position in the moving hole 250. By an elastic force provided by the support spring 458, the stopper 450 is maintained at the engaging position, that is, a position at which the engaging teeth 455 and the coupling teeth 255 are fixedly tooth-coupled and engaged with each other. When an external force allowing the stopper 450 to escape from the engaging position supported by the support spring 458, for example, a force pressing the support spring 458, is not provided, the stopper 450 is maintained at the engaging position and provides a fixing force to allow the slider 400 and the upper end of the gas spring 300 to be maintained at a fixed position.

Referring to FIG. 6, when the user presses the stopper 450, the flange 454 presses the support spring 458, and the stopper 450 moves downward to the release position. At the release position, the engaging teeth 455 have escaped from the moving hole 250 and moved into the accommodation groove 414. When the stopper 450 is at the release position, since teeth of the engaging teeth 455 escape from the coupling teeth 255 of the moving hole 250, a force fixing the slider 400 at a specific position in the moving hole 250 is removed. Accordingly, the user may move the slider 400 to adjust a desired position of the upper end 320 of the gas spring 300.

After adjusting the position of the upper end 320 of the gas spring 300, the force pressing the flange 454 of the stopper 450 is removed, the stopper 450 is moved to the engaging position, that is, the engaging teeth 455 are moved upward into the moving hole 250 by an elastic force of the support spring 458, and the engaging teeth 455 are engaged with the coupling teeth 255 again. Accordingly, a position of the upper end of the gas spring 300 is fixedly adjusted.

As the upper ends 320 of the gas springs 300 approach longitudinal lower ends 252 of the moving holes 250, a force applied to move the operating arms 200 to the approach positions increases, and as the upper ends 320 of the gas springs 300 approach longitudinal upper ends 251 of the moving holes 250, a force applied to move the operating arms 200 to the approach positions decreases. By adjusting fixing positions of the upper ends 320 of the gas springs 300 using the sliders 400, a magnitude of an elastic force applied by the chest expander can be adjusted. Accordingly, the user can perform exercise after adjusting the magnitude of the elastic force applied by the chest expander according to his or her muscle strength or to a desired magnitude.

According to the present invention, a magnitude of an elastic force provided by a gas spring in a chest expander can be easily adjusted.

According to a chest expander according to the present invention, an upper end of a gas spring fixed to an operating arm can be easily unfixed by moving a stopper provided in a slider from an engaging position to a release position, and a position of the upper end can be easily adjusted. Accordingly, a magnitude of an elastic force provided by the gas spring can be easily adjusted.

According to the present invention, a position of an upper end of a gas spring can be adjusted using a relatively simplified configuration, and a fixing force at the adjusted position can be secured.

The above description of the present invention is only exemplary, and it will be understood by those skilled in the art that the present invention may be easily changed to other concrete forms without changing the technological scope and essential features. Therefore, the above-described embodiments should be considered as only examples in all aspects and not for purposes of limitation. It should be interpreted that the scope of the present invention is defined by the appended claims and encompasses all modifications or alterations derived from meanings, the scope, and equivalents of the appended claims.

What is claimed is:

1. A chest expander comprising:

a head;

two operating arms whose upper end portions are coupled to the head using rotating shafts and which move toward or away from each other;

at least one gas spring, disposed between and coupled to the two operating arms, having a lower end rotatably connected to one operating arm and an upper end rotatably connected to the other operating arm, the upper end being connected to a moving hole formed in the upper portion of the other operating arm, wherein coupling teeth are formed along a longitudinal inner surface of the moving hole; and a slider coupled to the upper end of the at least one gas spring and configured to adjust a position of upper end of the at least one gas spring by moving along the moving hole, the slider comprising:

a slider body connected to the upper end of the at least one gas spring through a coupling shaft, the slider body including a first body and a second body which are disposed on both side surfaces of the upper portion of the operating arm, respectively, and coupled to each other with the moving hole interposed therebetween; and a stopper having a shaft shape, movably disposed between and supported by the first body and the second body, and configured to engage with the moving hole to fix the upper end of the at least one gas spring at an adjusted position, the stopper including engaging teeth protruding from an outer circumferential surface of the stopper and engageable with the coupling teeth, wherein:

the stopper is movable between an engaging position at which the engaging teeth engage with the coupling teeth to fix the slider at the adjusted position and a release position at which the engaging teeth escape from the coupling teeth to allow the slider to move along the moving hole; and the stopper is movable in an axial direction intersecting the moving hole such that the engaging teeth are disposed in the moving hole at the engaging position and escape from the moving hole at the release position.

2. The chest expander of claim 1, further comprising a support spring which presses the stopper toward the engaging position such that the engaging teeth of the stopper remain engaged with the coupling teeth in the moving hole at the engaging position.

3. The chest expander of claim 2, further comprising:

an accommodation groove formed in an inner surface of the first body, and configured to accommodate the engaging teeth of the stopper at the release position.

4. The chest expander of claim 2, wherein:

the stopper extends outward from the second body;

a flange is formed at an upper end of the stopper; and the support spring is interposed between the flange and the second body.

5. The chest expander of claim 1, wherein:

tooth parts are formed on outer circumferential surfaces of the upper end portions of the two operating arms; and the two operating arms are coupled to the head such that the tooth parts are rotatably engaged with each other.

6. The chest expander of claim 1, wherein:

the at least one gas spring includes two gas springs; and the two gas springs are alternately disposed on a front surface and a rear surface of the two operating arms.

7. The chest expander of claim 1, wherein the slider body further includes a moving guide disposed in the moving hole and having a smooth surface on a side surface facing the coupling teeth of the moving hole.

* * * * *